US008668546B2

(12) United States Patent
Rudell et al.

(10) Patent No.: US 8,668,546 B2
(45) Date of Patent: Mar. 11, 2014

(54) REMOTE SIGNAL RESPONSIVE SMALL VEHICLE WITH FREE WHEELING FEATURE

(75) Inventors: Elliot Rudell, Torrance, CA (US); Tom Grimm, St. Helena, CA (US)

(73) Assignee: Rudell Design, LLC, Torrance, CA (US)

( * ) Notice: Subject to any disclaimer, the term of this patent is extended or adjusted under 35 U.S.C. 154(b) by 1829 days.

(21) Appl. No.: 10/465,376

(22) Filed: Jun. 18, 2003

(65) Prior Publication Data

US 2004/0209545 A1 Oct. 21, 2004

Related U.S. Application Data

(60) Provisional application No. 60/463,811, filed on Apr. 17, 2003.

(51) Int. Cl.
*A63H 30/00* (2006.01)
*A63H 17/00* (2006.01)

(52) U.S. Cl.
USPC ..... 446/454; 446/465

(58) Field of Classification Search
USPC ..... 446/431, 436, 441, 448, 449, 466, 465, 446/470, 471, 446, 454–459, 461
See application file for complete search history.

(56) References Cited

U.S. PATENT DOCUMENTS

| | | | | |
|---|---|---|---|---|
| 3,538,640 | A * | 11/1970 | Hayes et al. | 446/454 |
| 3,797,404 | A * | 3/1974 | Barlow et al. | 104/304 |
| 4,183,174 | A * | 1/1980 | Barris et al. | 446/456 |
| 4,241,534 | A * | 12/1980 | Larsson et al. | 446/464 |
| 4,272,918 | A * | 6/1981 | Inoue | 446/300 |
| 4,540,380 | A * | 9/1985 | Kennedy et al. | 446/463 |
| 5,135,428 | A * | 8/1992 | Shibayama et al. | 446/463 |
| 5,135,429 | A | 8/1992 | Gefen et al. | |
| 5,816,887 | A | 10/1998 | Rudell et al. | |
| 6,179,686 | B1 * | 1/2001 | Ogawa et al. | 446/429 |
| 6,206,751 | B1 * | 3/2001 | Lee | 446/431 |
| 6,371,830 | B1 * | 4/2002 | Wu et al. | 446/457 |
| 2001/0045978 | A1 * | 11/2001 | McConnell et al. | 348/42 |

OTHER PUBLICATIONS

"Monster 4X4", Shaper Toys Catalog, 1985, pp. 14-15.
"Radio Control Ride-On Train", Tyco Preschool, 1996, p. 25.
"Radio Control Ride-On Train", Tyco Preschool, 1996.
"Tyco RC Ride-On Train", 1996.
"Radio Control Railroad", Tyco Preschool, 1998.
AFX® Ultra 5 ™ Pro AM Classic ™ 4 Race Set, Aurora Products, 1977, pp. 6 and 3.

* cited by examiner

*Primary Examiner* — Gene Kim
*Assistant Examiner* — Alyssa Hylinski
(74) *Attorney, Agent, or Firm* — Ben J. Yorks; Irell & Manella LLP

(57) ABSTRACT

A hand held remote controlled toy vehicle. The toy vehicle includes a motor that can be activated by a wireless signal. The motor is coupled to a drive wheel by a drive gear assembly. Activation of the motor turns the drive wheel and propels the vehicle. The drive gear assembly can be de-coupled from the drive wheel so that the toy vehicle can be manually propelled in a free-wheeling mode.

14 Claims, 2 Drawing Sheets

REMOTE SIGNAL RESPONSIVE SMALL VEHICLE WITH FREE WHEELING FEATURE

REFERENCE TO CROSS-RELATED APPLICATIONS

This application claims priority to provisional Application No. 60/463,811, filed Apr. 17, 2003.

BACKGROUND OF THE INVENTION

1. Field of the Invention

The present invention relates to hand held remote controlled toy vehicles.

2. Prior Art

Remote controlled toy vehicles typically contain a motor that is mechanically linked to a drive wheel. The motor is activated by a signal that is received by a wireless receiver of the toy. Activation of the motor turns the drive wheel and propels the toy vehicle. The signal is generated by a remote control transmitter that is operated by an end user. The signal may be either radio frequency ("RF") or infrared ("IR").

There have been marketed numerous remote controlled toy vehicles. For example, Fisher-Price marketed remote controlled toys under the trademarks RC RACEWAY and RC OFF-ROAD ADVENTURE that ran along tracks. Tyco Preschool, that later became a part of Fisher-Price, marketed a number of remote controlled vehicles under the SESAME STREET brand name. SESAME STREET RADIO CONTROLLED RIDE-ON TRAIN was a full sized radio controlled train that a child could ride and move about a track. The train could be removed from the track and manually propelled by the child in a free-wheeling mode. The RIDE-ON TRAIN had four axles. Each axle had a small wheel and a large wheel. The small wheels were coupled to the motor and powered the train on the track. The large wheels freely spun about the axles and were not mechanically coupled to the motor. The large wheels were in contact with the ground when the train was not on the track. The dual wheel design prevented the need to disengage the motor powered wheels from the motor.

There had been marketed motor driven toy vehicles that allowed for "free-wheel" movement of the vehicles. SESAME STREET PRESS & GO RACERS were a spring-motor based toy that could free wheel along a surface. SCHAPER'S STOMPERS contained battery operated motors and had a free wheeling capability. Neither one of these toys were wirelessly controlled.

U.S. Pat. No. 5,816,887 issued to Rudell et al. discloses a remote controlled train set. The train set includes an auxiliary feature that allows the end user to remotely load and unload cargo from the train. Like the other miniature remote controlled vehicles of the prior art the train cannot be manually propelled by the end user without back turning and causing damage to the motor. It would be desirable to provide a hand held remote controlled toy vehicle that can be manually propelled in a free-wheeling mode.

BRIEF SUMMARY OF THE INVENTION

A toy vehicle that includes a wheel and a motor that are both coupled to a housing. The motor is also coupled to a wireless receiver. The toy vehicle further includes a drive gear assembly that is coupled to the motor and can be coupled to, or de-coupled from, the drive wheel.

DETAILED DESCRIPTION

Disclosed is a remote controlled toy vehicle. The toy vehicle includes a motor that can be activated by a wireless signal. The motor is coupled to a drive wheel by a drive gear assembly. Activation of the motor turns the drive wheel and propels the vehicle. The drive gear assembly can be de-coupled from the drive wheel so that the toy vehicle can be manually propelled in a free-wheeling mode.

Figure 1:
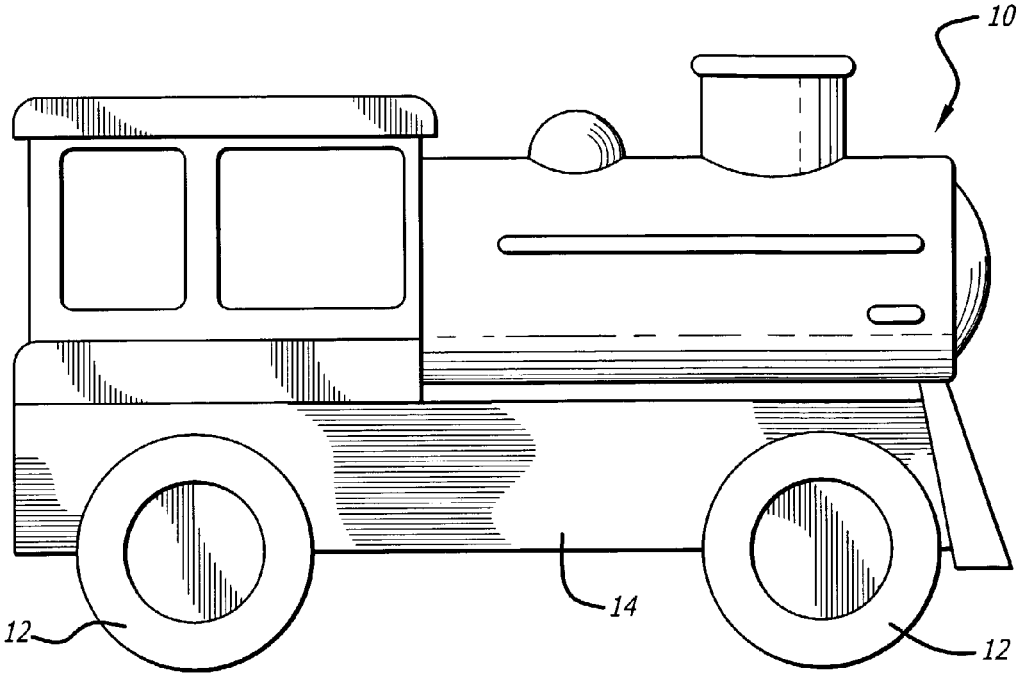
FIG. 1 is a side view of a toy vehicle.

Referring to the drawings more particularly by reference numbers, FIG. 1 shows an embodiment of a toy vehicle 10. The toy vehicle 10 may have a plurality of wheels 12 that are coupled to a housing 14. The housing 14 may be a molded plastic part that has the appearance of a train. Although a toy train is shown, it is to be understood that the housing 14 may have other shapes and appearances. The vehicle 10 is preferably no longer than 16 inches and no wider than 8 inches.

Figure 2:
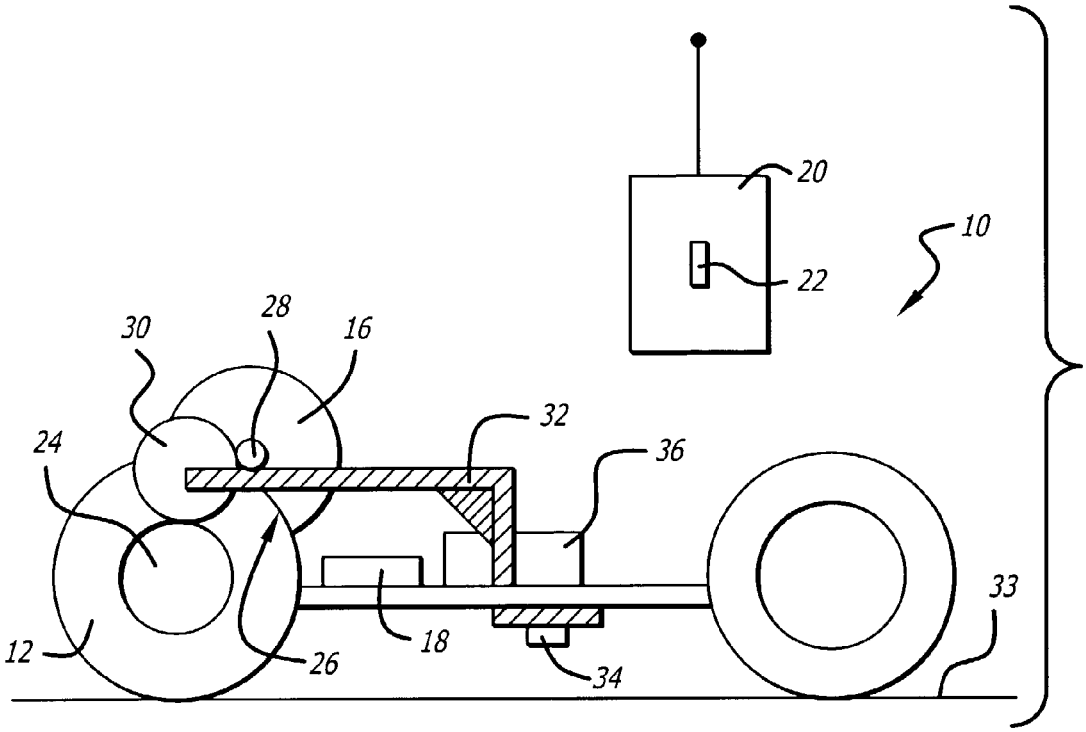
FIG. 2 is a side view of the toy vehicle showing a drive gear assembly coupled to a drive wheel.

FIG. 2 shows an embodiment of the toy vehicle 10. The vehicle 10 may have an electric motor 16 that is connected to a wireless transceiver 18. The wireless transceiver 18 receives wireless signals from a remote control transmitter 20. The transmitter 20 may have a switch, a button or a knob 22 that can be manipulated by an end user to send the wireless signal. By way of example, the wireless signal may be RF or IR.

One or more of the wheels 12 may have a gear 24. The vehicle 10 has a drive gear assembly 26 that couples the wheel gear 24 to an output gear 28 of the motor 16. The drive gear assembly 26 may include a drive gear 30 attached to a bracket 32. Rotation of the output gear 28 spins the drive gear 30 and turns the wheel gear 24 to propel the vehicle 10 across a surface 33. The output gear 28 rotates when the receiver 18 receives a wireless signal and the motor 16 is activated.

Figure 3:
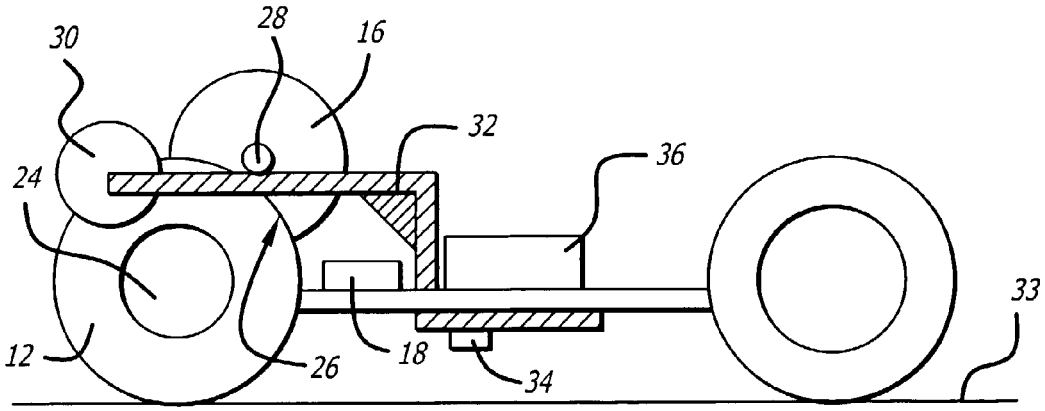
FIG. 3 is a side view of the toy vehicle showing the drive gear assembly de-coupled from the drive wheel.

The drive gear assembly 26 may include a tab 34 that can be manually moved by an end user to de-couple the drive gear 30 from the wheel gear 24 as shown in FIG. 3. This allows the end user to manually propel the vehicle 10 in a free-wheeling mode without back turning the motor 16. The tab 34 may also be coupled to a switch 36 that turns the motor 16 off when the drive gear 30 is de-coupled from the wheel gear 24, and turns the motor 16 on when the drive gear 30 is coupled to the gear 24.

Figure 4:
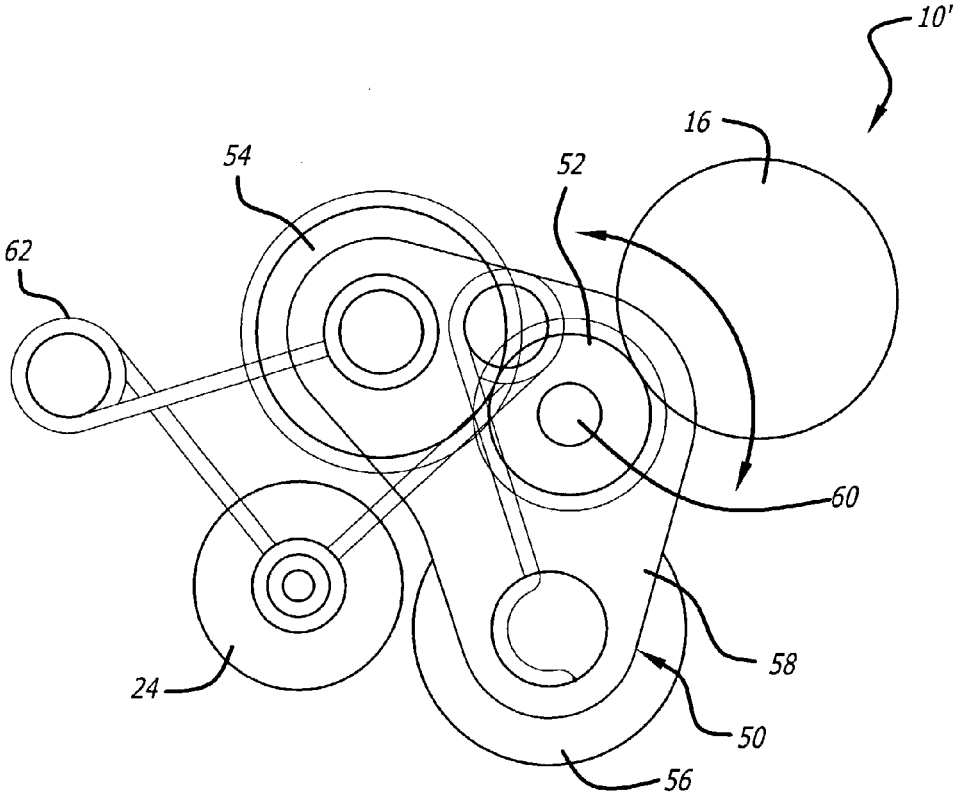
FIG. 4 is an alternate embodiment of a drive gear assembly.

FIG. 4 shows another embodiment of a toy vehicle 10' with a drive gear assembly 50 that can be automatically de-coupled from the wheel gear 24 when the motor 16 is not activated. The drive gear assembly 50 may include a first drive gear 52 coupled to a pair of second drive gears 54 and 56. The first drive gear 52 is also coupled to the motor 16.

The drive gears 52, 54 and 56 are attached to a carriage 58. The carriage 58 is pivotally connected to a pin 60 that is attached to the vehicle housing 14. Activation of the motor 16 spins the drive gear 52 and creates a torque on the carriage 58. The torque pivots the carriage 58 as indicated by the arrows so that one of the second drive gears 54 or 56 engages the wheel gear 24 and spins the wheel (not shown). Clockwise rotation of the first drive gear 52 will cause the second gear 56 to engage the wheel gear 24. Counterclockwise rotation of the drive gear 52 will cause the second gear 54 to engage the wheel gear 24.

The toy vehicle 10' may include a spring 62 that biases the carriage 58 into a neutral position, so that neither gear 54 or 56 engage the wheel gear 24 when the motor 16 is not activated. When in the neutral position the end user can manually propel the vehicle 10' in a free-wheeling mode. This embodiment provides an automatic coupling between the drive gear assembly 50 and the wheel gear 24 when the motor 16 is activated, and an automatic de-coupling of the gear assembly 50 and the gear 24 when the motor 16 is deactivated.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy vehicle, comprising:

a housing;

a wheel coupled to said housing;

a motor coupled to said housing;

a wireless receiver coupled to said motor and said housing said wireless receiver receives a wireless signal; and, a drive gear assembly that couples said motor to said wheel when said wireless receiver receives the wireless signal and allows said wheel to freely rotate when said wireless receiver does not receive the wireless signal.

2. The vehicle of claim 1, wherein said housing is less than 16 inches long.

3. The vehicle of claim 1, wherein said wireless receiver receives signals in a radio frequency range.

4. The vehicle of claim 1, wherein said drive gear assembly includes a drive gear and a bracket that is coupled to said housing.

5. The vehicle of claim 4, wherein said drive gear assembly includes a tab coupled to said bracket.

6. The vehicle of claim 5, further comprising an electrical switch that is coupled to said tab and said motor.

7. The vehicle of claim 1, wherein said drive gear assembly includes a carriage that supports a first drive gear that is coupled to said motor, and a second drive gear that can be coupled to, and de-coupled from, said wheel.

8. A toy vehicle, comprising:

a housing;

a wheel coupled to said housing;

a motor coupled to said housing;

wireless receiver means for receiving a wireless signal; and, drive gear means for coupling said motor to said wheel when said wireless receiver means receives the wireless signal, and for automatically de-coupling said motor from said wheel so that said wheel can freely rotate when said wireless receiver means does not receive the wireless signal.

9. The vehicle of claim 8, wherein said housing is less than 16 inches long.

10. The vehicle of claim 8, wherein said wireless receiver means receives signals in a radio frequency range.

11. The vehicle of claim 8, wherein said drive gear means includes a drive gear and a bracket coupled to said housing.

12. The vehicle of claim 11, wherein said drive gear means includes a tab coupled to said bracket.

13. The vehicle of claim 12, further comprising an electrical switch that is coupled to said tab and said motor.

14. The vehicle of claim 8, wherein said drive gear means includes a carriage that supports a first drive gear that is coupled to said motor, and a second drive gear that can be coupled to, and decoupled from, said wheel.

* * * * *